United States Patent [19]

Fiala

[11] 4,246,879

[45] Jan. 27, 1981

[54] FUEL INJECTION APPARATUS

[75] Inventor: Ernst Fiala, Wolfsburg, Fed. Rep. of Germany

[73] Assignee: Volkswagenwerk Aktiengesellschaft, Fed. Rep. of Germany

[21] Appl. No.: 827,808

[22] Filed: Aug. 25, 1977

[30] Foreign Application Priority Data

Aug. 27, 1976 [DE] Fed. Rep. of Germany ..... 2638666

[51] Int. Cl.[3] ..... F02M 69/08

[52] U.S. Cl. ..... 123/533; 123/535; 123/550; 123/568; 261/50 A

[58] Field of Search ..... 123/119 R, 139 AW, 139 E, 123/34 R, 35, 122 AA, 122 G, 122 F; 261/50 A

[56] References Cited

U.S. PATENT DOCUMENTS

| | | | |
|---|---|---|---|
| 1,460,667 | 7/1923 | Good | 123/119 R |
| 3,168,084 | 2/1965 | Simonet | 123/119 R |
| 3,198,498 | 8/1965 | Mennesson | 123/119 R X |
| 3,259,378 | 7/1966 | Mennesson | 123/119 R X |
| 3,285,585 | 11/1966 | Mennesson | 261/50 A X |
| 3,286,998 | 11/1966 | Mennesson | 261/50 A X |
| 3,404,667 | 10/1968 | Mennesson | 123/119 R |
| 3,713,630 | 1/1973 | Laprade et al. | 261/50 A X |
| 3,721,428 | 3/1973 | Gele et al. | 261/50 A X |

FOREIGN PATENT DOCUMENTS

| | | | |
|---|---|---|---|
| 1281746 | 10/1968 | Fed. Rep. of Germany | 261/50 A |
| 1281748 | 10/1968 | Fed. Rep. of Germany | 261/50 A |

*Primary Examiner*—Tony M. Argenbright
*Attorney, Agent, or Firm*—Brumbaugh, Graves, Donohue & Raymond

[57] ABSTRACT

A fuel injection apparatus for use with an internal combustion engine provides for the injection of a fuel carrying air stream into the intake manifold of the engine adjacent the intake port of each cylinder. The apparatus includes a fuel proportioning device which releases a quantity of fuel to the fuel carrying air stream in accordance with the rate of air flow in the engine air intake.

30 Claims, 7 Drawing Figures

FUEL INJECTION APPARATUS

BACKGROUND OF THE INVENTION

This invention relates to fuel injection devices, and particularly to devices for injecting fuel into the intake manifold of an internal combustion engine.

The requirements for lower emissions of polluting substances from automobile engines, and demands for increased engine efficiency require accurate control and distribution of fuel in an internal combustion engine. Better control of the fuel mixture can be achieved by the use of complex carburetor arrangements, which may be expensive and unreliable in operation. A preferred approach is fuel injection, which can provide uniform distribution of fuel to the cylinders of the engine as well as precise fuel quantity control. Prior art devices for direct liquid fuel injection into the combustion chamber require delivery of small measured quantities of fuel at high pressure, and consequently require precision made parts, rendering the entire engine considerably more costly.

It is an object of the present invention to provide a new and improved means for supplying fuel uniformly to the combustion chambers of an internal combustion engine with precise control over the fuel quantity.

It is a further object of the invention to provide such an apparatus which is relatively inexpensive and can achieve good mixing and preparation of the fuel-air mixture supplied to the combustion chambers.

SUMMARY OF THE INVENTION

In accordance with the invention, there is provided an apparatus for injecting fuel into the intake manifold of an internal combustion engine having at least one combustion chamber and an intake passage through which there is an air flow to the combustion chamber. The apparatus includes means for generating a continuous stream of air, separate from the air flow in the intake passage. A fuel proportioning means, which is responsive to the rate of air flow through the intake passage releases fuel into the separate air stream in accordance with the rate of intake passage air flow. The fuel bearing air stream is provided to the intake manifold of the engine, preferably at a location adjacent the intake opening of each cylinder.

The fuel proportioning means may include a constriction through which the separate air stream flows. A first orifice can be provided in the constriction and there may be a reservoir connected to the first orifice by a second orifice, which has a controlled opening, for example, a tapered nozzle pin which moves in and out of the second orifice. The position of the nozzle pin may be controlled by a flap in the air intake passage, or may be determined by a control ring in the air intake. The position of the control ring changes with respect to a fixed tapered bullet in accordance with the rate of air flow through the air intake passage. The air stream may be drawn through the fuel proportioning means by a pump. The pump rate may be fixed or may be varied using a variable speed motor or a controlled pump bypass. A portion of the pump outlet may be supplied to the intake air passage to be ingited and thereby partially react the intake gases flowing to the engine. A portion of the pump outlet may also be supplied to a fuel tank to pressurize the tank and thereby eliminate the need for a separate fuel pump. In this case, it is preferable that a pressure reducing valve be arranged between the pump and the fuel tank. The fuel bearing air stream may be conditioned prior to injection into the intake manifold by heating or by mixture with exhaust gases.

For a better understanding of the invention, together with other and further objects, reference is made to the following description, taken in conjunction with the accompanying drawings, and its scope will be pointed out in the appended claims.

DESCRIPTION OF THE INVENTION

Figure 1:
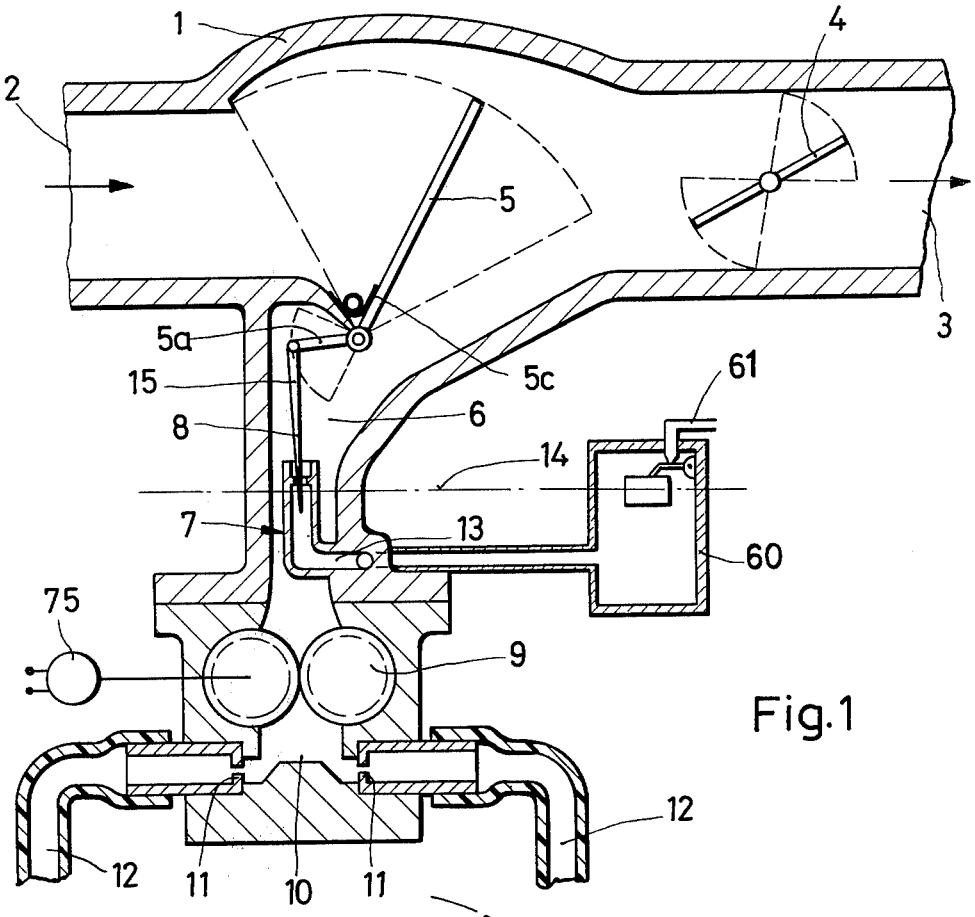
FIG. 1 is a cross-sectional view of a fuel injection apparatus in accordance with the invention.

In FIG. 1, there is shown a cross-sectional view of a portion of an air intake passage 1 for an internal combustion engine. Air is provided to the illustrated portion of the passage by an inlet 2, which may be connected to an air filter, and is provided through outlet 3 to the engine intake manifold. A throttle 4 is provided in the passage and may be rotated to various positions in order to regulate the quantity of air supplied to the engine, and consequently the engine operating speed and power. Prior to throttle 4 in the direction of flow, there is provided a baffle flap 5, which is pivotably mounted and moves against a spring **5*c* urging the baffle flap against the direction of air flow. According to the rate of air flow through the air intake passage 1, flap 5 will be moved to an open position, from left to right in the drawing with increased flow, and by means of lever 5*a*, flap 5** controls the quantity of fuel provided to the engine.

Between flap 5 and throttle 4, there is provided a branch passage 6 through which pump 9 draws a separate stream of air. The separate air stream flows past a fuel proportioning apparatus 7 which releases fuel to the air stream according to the position of nozzle pin 8, which is connected to flap lever **5*a* by a connecting rod 15. Nozzle pin 8 dips into fuel reservoir 13 wherein the fuel is maintained at a constant level 14 by float chamber 60. As required, float chamber 60 is provided with additional fuel from fuel line 61** according to the position of the float valve.

The fuel carrying air stream at the outlet of pump 9 is provided to a flow dividing device 10 which is provided with first nozzles 11, the number of nozzles corresponds to the number of cylinders in the engine. Passages 12 conduct the fuel carrying air stream to the intake manifold in the region adjacent the intake ports of the cylinders. The fuel carrying air stream is injected into the manifold as finely divided spray by the use of second spray nozzles 63 in the manifold.

As may be seen by reference to FIG. 1, nozzle pin 8 is connected by rod 15 to lever arm **5*a* of flap 5. When flap 5 swings to the right, under the force of increased air flow through air passage 1, nozzle pin 8 is lifted. Pin 8 has a tapered cross-section which decreases in the downward direction. Upon lifting of the pin, a greater annular opening is provided in the orifice between fuel reservoir 13 and air stream passage 6**.

Figure 2:
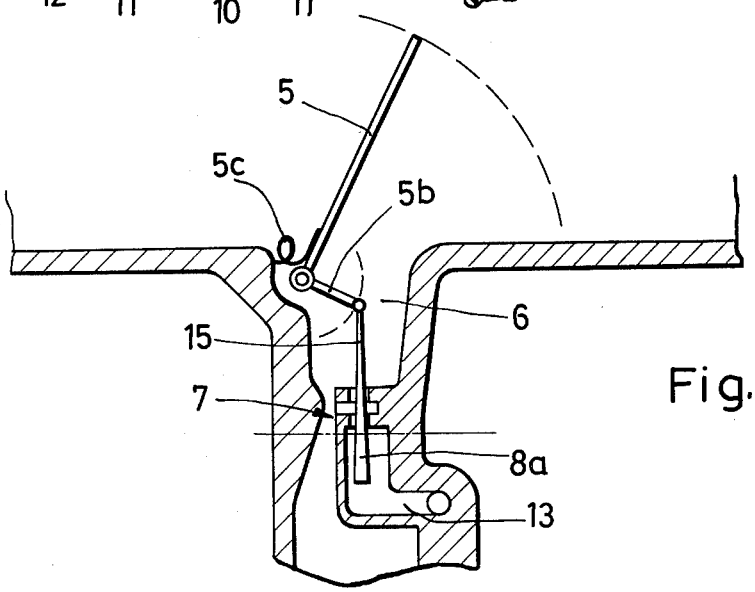
FIG. 2 is a cross-sectional view showing an alternate configuration for the fuel proportioning means of the FIG. 1 apparatus.

An alternate arrangement for the fuel proportioning apparatus is illustrated in FIG. 2 wherein lever 5*b* is arranged to lower connecting rod 15 and pin 8*a* when air flow through intake passage 1 increases. Consequently, the cross-section of pin 8*a* is tapered to increase in a downward direction on the pin, so that a larger opening between fuel reservoir 13 and air stream passage 6 is provided upon an increased air intake flow.

Figure 3:
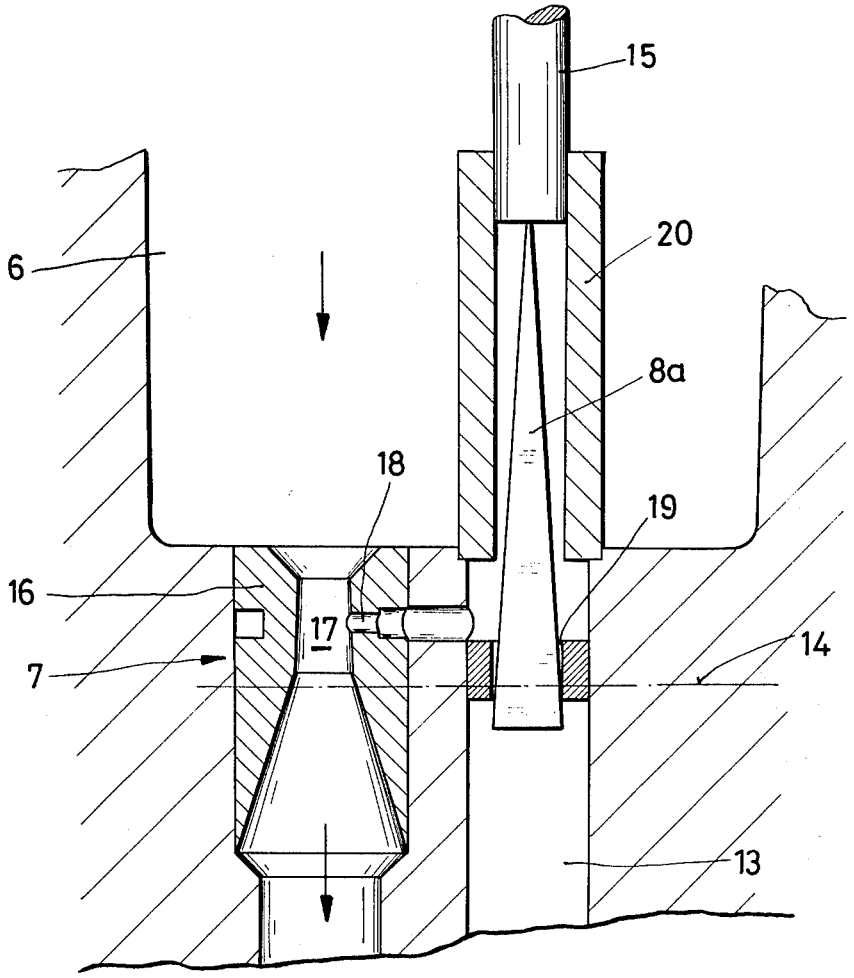
FIG. 3 is a detailed cross-sectional view of the FIG. 2 apparatus.

The fuel proportioning means illustrated in FIG. 2 is shown in greater detail in the cross-sectional view of FIG. 3. FIG. 3 shows that a venturi-like constriction 16 is provided in air stream passage 6 and at the narrowest region 17 of the constriction, there is provided a first orifice 18 which is in communication with a second orifice 19 through which nozzle pin 8*a* is moved by connecting rod 15. A cylindrical guide 20 surrounding connecting rod 15 prevents the flow of the air stream into the region surrounding nozzle pin 8*a*. The fuel level in fuel reservoir 13 is maintained at a constant level by the float chamber, which is not shown in FIG. 3. As air flow through air intake 1 increases, connecting rod 15 and pin 8*a* move downward to increase the annular flow cross-section through orifice 19. Because of the larger opening in orifice 19, more fuel will be drawn through orifice 18 by the air flow in constriction 16. The arrangement of FIGS. 2 and 3, wherein pin 8*a* has a larger diameter at its lower end, has a special advantage. Rapid increase of the air flow in passage 1 causes nozzle pin 8*a* to dip into reservoir 13 resulting in a brief rise in the level 14 at which fuel in the reservoir is maintained. The fuel level increase causes a brief increase in the flow of fuel through orifices 19 and 18 into the air stream.

The devices shown in FIGS. 1 through 3 provide a release of fuel into the separate air stream in a quantity which is proportional to the air flow in the air intake passage. This proportionality depends on the maintenance of a constant speed for pump 9 illustrated in FIG. 1. The pump illustrated is an electrically driven gear pump, and it will be recognized that it is possible to vary the volume of the air stream by providing a variable speed motor 75, whose speed is changed according to the operating condition of the engine. For example, the speed of motor 75 may be increased when the vehicle on which the engine is mounted is accelerated or when the engine is cold. This will increase the flow of fuel into the engine. The speed of motor 75 may also be adjusted by an engine control device which derives control signals from measurements of engine operating parameters, for example measurement of oxygen partial pressure in the exhaust flow or continuous measurements of tangential pressure. Data may be derived on engine operating conditions from these measurements and used to derive signals which optimize the speed of motor 75, and consequently the quantity of fuel being provided to the engine.

Figure 7:
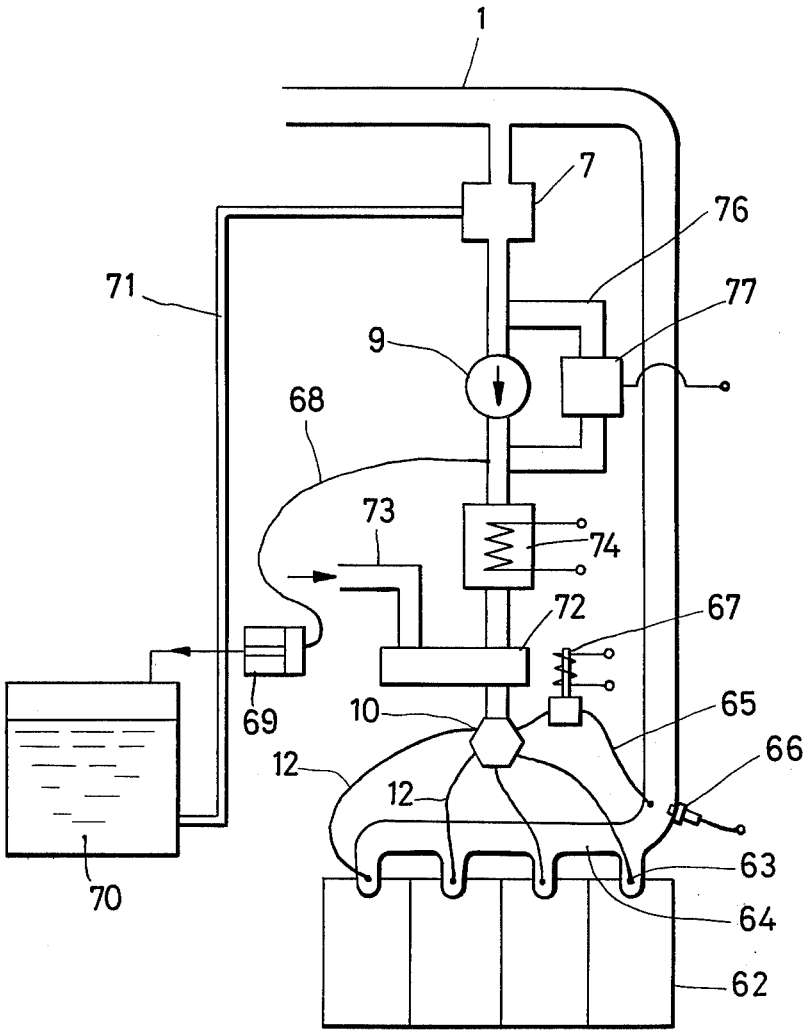
FIG. 7 is a diagram illustrating the interconnection of the fuel injection apparatus of the invention with an engine and fuel tank.

As an alternate to electric control of the volume flow of pump 9, mechanical control may be provided by the use of a bypass 76 having a controllable valve 77 as illustrated in FIG. 7. Bypass 76 connects the suction side of pump 9 to the pressure side. Opening of valve 77 decreases the flow volume in the air stream. An alternate technique for changing the ratio of fuel to air delivered to the engine is to mechanically vary the tension provided in the restoring spring 5*c* bearing against flap 5.

The flow dividing device 10, which receives the outlet of pump 9 includes a plurality of nozzles 11 which connect to lines 12 leading to the intake manifold in the region of the intake ports of the combustion chambers. Generally, the number of nozzles 11 and feed lines 12 should be equal to the number of combustion chambers in the engine. An alternate arrangement, illustrated in FIG. 7, has at least one divider outlet line 65 in excess of the number of combustion chambers of the engine. The dividing device 10 of FIG. 7 has five outlets and is used with a four cylinder engine 62. Four of the lines 12 are connected by spray nozzles 63 to the intake manifold 64 adjacent the inlet ports of engine 62. The extra line 65 is connected to a nozzle on intake passage 1 to supply a portion of the fuel carrying air stream to the intake air passage. In order to heat the intake air during cold starting and warming up of the engine, an ignition device 66 is provided on the intake passage near the injection nozzle of passage 65. The ignition device ignites the fuel provided through passage 65 and thereby partially reacts the fuel to rapidly heat the intake air. A control valve 67, which is preferably magnetically activated, is provided in passage 65 so that the fuel carrying air stream through passage 65 may be shut off when inlet mixture heating is no longer required.

Fuel mixture preparation may also be provided by means of a heating device for increasing the temperature of the fuel carrying air stream, such as electric heater 74, shown in FIG. 7 between pump 9 and flow dividing device 10. An advantage of heating of the injection air stream is that a lower capacity heater may be used, because of the relatively small flow volume of the fuel carrying air stream compared to the total air and fuel intake volume of the engine.

Figure 4:
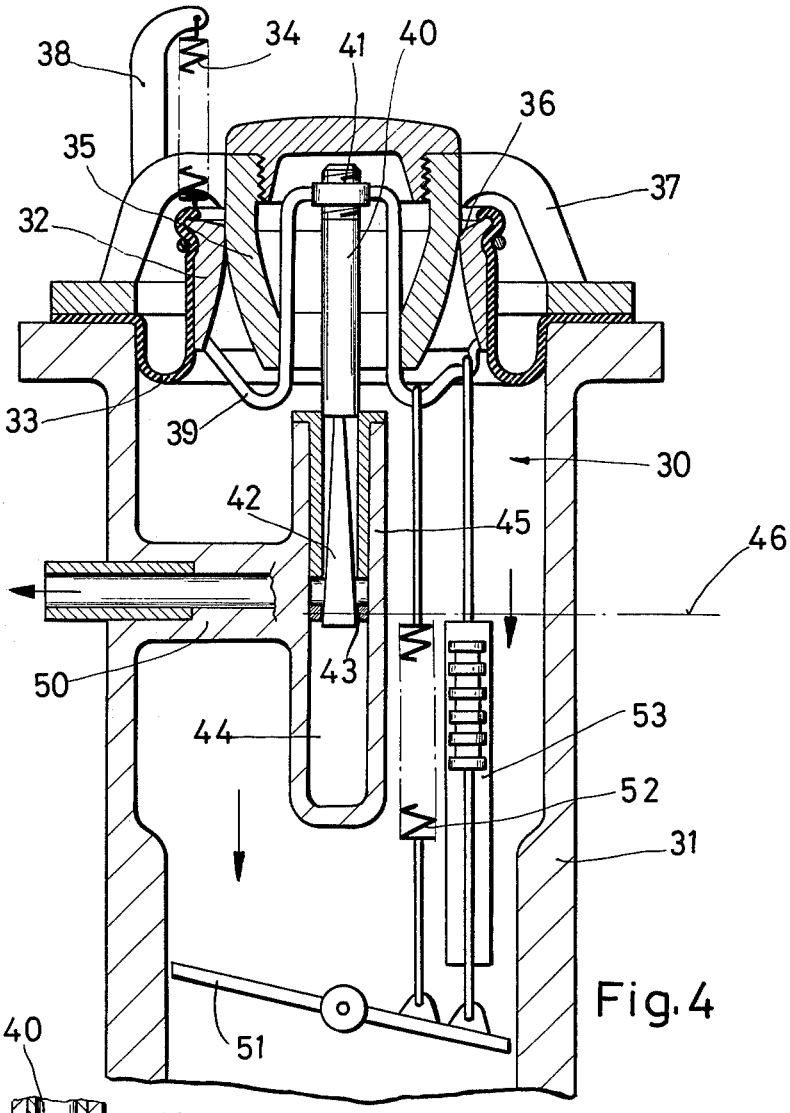
FIG. 4 is a cross-sectional view of an alternate fuel proportioning means used in the present invention.

FIG. 4 is a cross-sectional illustration of an alternate fuel proportioning device useful in the injecting apparatus of the invention. The arrangement shown in FIG. 4 is particularly compact and hence may be easily installed for use in a motor vehicle. The fuel proportioning device 30 is centrally located in a vertical intake passage 31. A tapered bullet 35 is centrally arranged in the intake passage and held in a fixed position by struts 37. A control ring 32 surrounds bullet 35 and is secured to intake passage 31 by rolling diaphragm 33. A spring 34, which is held on a branch 38 of strut 37 urges control ring 32 in an upward direction with respect to intake passage 31. Between bullet 35 and control ring 32, there exists an annular cross-sectional opening 36, the cross-section of which is varied by movement of control ring 32 in an axial direction with respect to bullet 35 and passage 31. Control ring 32 moves in a downward axial direction as air flow through passage 31 is increased.

Struts 39 connect control ring 32 to rod 40 on which tapered nozzle pin 42 is mounted. Screw 41 enables adjustment of the axial location of pin 42 with respect to control ring 32 in order to adjust the idle fuel flow of the device. A cylindrical guide 45 is mounted coaxially in intake 31 and serves to guide the axial movement of rod 40 under the influence of control ring 32. A lower extension 44 of guide 45 forms a portion of a fuel reservoir in which fuel is kept at a constant level 45, which approximately corresponds to the location of orifice 43.

Figure 5:
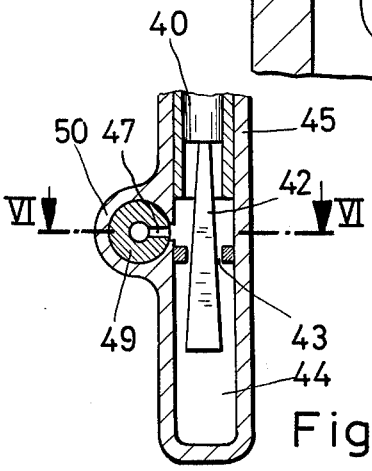
FIGS. 5 and 6 are detailed cross-sectional views of portions of the FIG. 4 apparatus.
Figure 6:
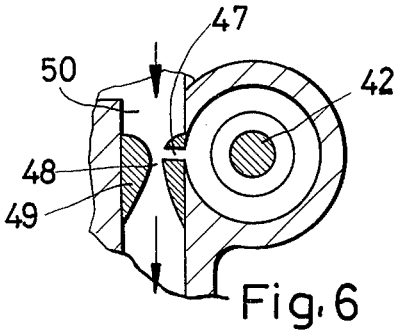

FIG. 5 is a longitudinal cross-section of the fuel reservoir and guide cylinder rotated 90° from the FIG. 4 view. FIG. 6 is a transverse cross-section taken along the lines shown in FIG. 5. A tubular passage 50 has its output connected to a pump so that an air stream is drawn from intake passage 31 through passage 50. A first orifice 47 is provided connecting the narrowest cross-section 48 of a venturi-like constriction 49 in air stream passage 50 to the space directly above second orifice 43. The vacuum caused by the air stream flow through venturi 49 draws fuel into the air stream according to the opening in second orifice 43. Tapered pin 42 controls the opening of second orifice 43 in a manner similar to pin 8*a* illustrated in FIG. 3.

The action of air flow through passage 31 on control ring 32 regulates the quantity of fuel provided to the engine by fuel proportioning means 30. The rate of air flow through intake 31 is controlled by throttle 51, which is located in passage 31 at a point following the fuel proportioning means in the direction of air flow. In some cases, for example, cold starting, full load, or acceleration of the engine, it may be desired to provide additional quantities of fuel to the engine. In this event, various control devices may be provided to act on struts 39 and move ring 32 and pin 42 into a position for greater release of fuel into the air stream in passage 50. Spring 52 may be provided connecting throttle 51 with strut 39 so that upon full opening of throttle 51, spring 52 will cause additional downward movement of control ring 32 and consequently pin 42 to supply additional fuel to the engine. There may also be provided a damper 53 interconnecting throttle 51 and strut 39. Damper 53 includes a piston acting in a cylinder containing a hydraulic fluid so that on rapid opening of throttle 51, additional downward movement will be imparted to control ring 42 and consequently nozzle pin 42. According to the stiffness of damper 53, the nozzle pin and control ring will gradually return to their usual positions as the damper piston and cylinder move with respect to each other. Control ring 32 will return to its normal position under the influence of return spring 34.

Other control means may act on struts 39. A manual or automatic choke setting mechanism can be provided to cause an increase in fuel flow for cold starting by depression of strut 39 and consequently nozzle pin 42.

The overall arrangement illustrated in FIGS. 4 through 6 is especially compact and may be used with the pump and fuel distributing means shown in FIGS. 1 and 7.

Another modification of the injection apparatus is shown in FIG. 7, wherein there is provided a device 72 for mixing exhaust gases provided on passage 73 with the fuel carrying air stream. Such exhaust gas recycling is known to reduce formation of pollutants, especially nitrous oxides, in internal combustion engines. Mixing device 72 is preferably arranged to control the return of exhaust gases according to the operating condition of the engine. Control can be provided by a measurement or sensing of the intake vacuum or throttle setting as a variable. Mixing of exhaust gas into the separate air stream, which is injected into the intake manifold adjacent the combustion chamber ports, assures a uniform distribution of the recirculated exhaust gasses to the combustion chambers of the engine so that the injected fuel droplets are immersed in an atomosphere of low oxygen gas to lower peak combustion temperatures. Exhaust gas recycling additionally provides preheating of the fuel carrying air stream thereby improving fuel preparation.

If a suitable catalyst is provided in mixing device 72, a partial thermal reaction may be achieved by the mixture of hot exhaust gases with the fuel carrying air stream. This reaction can result in partial dissociation of liquid or vapor fuel components into gaseous carbon monoxide and hydrogen. This dissociation, similar to the process which takes place in a reaction carburetor, promotes low emissions from the engine, particularly under partial load and cold starting conditions.

The outlet of pump 9 may be connected to a vehicle fuel tank 70 by passage 68 thereby pressurizing the fuel tank with the fuel carrying air stream and eliminating the need for a conventional fuel pump. A pressure reducer 69 may be provided in passage 68 to reduce the level of air pressure in the fuel tank to the level required to deliver fuel to fuel proportioning device 7 by fuel line 71.

The use of a fuel carrying air stream which is injected into the intake manifold of an engine adjacent the combustion chamber inlet ports provides a relatively simple and inexpensive device for an accurate control of fuel flow to the engine. Metering and control of fuel release takes place at relatively small pressures and large flow volumes compared to conventional fuel injection devices. Consequently, more accurate proportioning of fuel can be achieved. The introduction of a rich fuel carrying air stream through atomizers into the intake manifold near the cylinder ports provides the uniform fuel distribution characteristic of direct liquid fuel injection, without the conventional high pressure components. The arrangement has the great advantage of a better preparation of the fuel supplied to the engine since in all engine operating conditions including full load the pump draws a fuel carrying air stream and not pure fuel like in conventional fuel injection devices. The better preparation is achieved by thoroughly mixing fuel and air at flowing through the pump, so that an extensively homogeneous fuel air mixture is fed to the injection points of the intake manifold. Entering the intake manifold the fuel carrying air stream expands because of the higher pressure in the feed lines than in the intake manifold thereby excellently being sprayed. This process of expanding and spraying of the fuel carrying air stream takes place also when there are no atomizers or spray nozzles at the ends of the feed lines, so that even such expensive atomizers can be omitted.

During the expansion of the fuel carrying air stream at least a part of the liquid fuel contained in the fuel air mixture evaporates thus further improving the preparation of the fuel air mixture and promoting complete and clean combustion.

The arrangement can be conveniently used to provide fuel mixture heating or other fuel preparation in a variety of manners as described.

It should be noted that as used herein the term "intake manifold" denotes the portion of the air intake passage immediately communicating with the combustion chamber inlet. The term therefore is intended to encompass a single passage used in a single cylinder engine or a cast-in passage which is a part of the engine block assembly.

While there have been described what are believed to be the preferred embodiments of the invention, those skilled in the art will recognize that other and further modifications may be made thereto without departing from the spirit of the invention, and it is intended to claim all such embodiments as fall within the true scope of the invention.

I claim:

1. Apparatus for injecting fuel into the intake manifold of an internal combustion engine having at least one combustion chamber with an intake port and having a first intake passage through which there is an air flow to said combustion chamber by said intake manifold, comprising:

a second passage, separate from said first passage and having a venturi-like constriction;

a pump following said constriction in said second passage, for drawing a continuous stream of air through said second passage, said pump having an output at a pressure which is greater than the pressure in said intake manifold;

fuel proportioning means comprising a fuel reservoir wherein fuel is maintained at a constant level, a first orifice communicating with said air passage constriction, and a second variable cross-section orifice, arranged between said first orifice and said fuel reservoir;

means, responsive to the rate of air flow in said first passage, for controlling the opening of said second orifice;

and means for supplying the pressurized fuel carrying air stream from said pump to said intake manifold adjacent said intake port.

2. Apparatus as specified in claim 1 wherein there is provided a nozzle pin, movable in said second orifice, thereby to vary said second orifice opening.

3. Apparatus as specified in claim 2 wherein said air intake passage includes a variable throttle, wherein there is provided a flap, connected to said nozzle pin for moving said pin in said orifice, said flap being arranged in said air intake passage ahead of said throttle in the direction of flow, and being movable by air flow through said air intake passage against a spring, thereby to move said pin.

4. Apparatus as specified in claim 2 wherein said nozzle pin is axially tapered and forms an annular opening in said second orifice, the cross-section of said annular opening varying according to the axial position of said pin.

5. Apparatus as specified in claim 4 wherein said pin is tapered to a larger cross-section on the portion of said pin extending through said second orifice and into said reservoir, whereby when said pin is dipped into said reservoir to open said second orifice, said pin temporarily raises said fluid level in said reservoir.

6. Apparatus as specified in claim 1 wherein said air intake passage includes a throttle and a flap responsive to air flow through said intake passage for operating said fuel proportioning means and wherein said pump draws said separate air stream from a portion of said air intake passage between said throttle and said flap.

7. Apparatus as specified in claim 1 wherein said pump is an electrically driven gear pump.

8. Apparatus as specified in claim 1 wherein there are provided means for varying the flow volume of said pump.

9. Apparatus as specified in claim 8 wherein said means for varying the flow volume of said pump comprises a variable speed electric motor for driving said pump.

10. Apparatus as specified in claim 8 wherein said means for varying the flow volume of said pump comprises mechanically operative means.

11. Apparatus as specified in claim 10 wherein said mechanically operative means comprises a bypass connecting the inlet and outlet of said pump and a variable opening valve arranged in said bypass.

12. Apparatus as specified in claim 1 wherein there are provided dividing means connected to the outlet of said pump for dividing said air stream into a number of passages at least equal to the number of said combustion chambers.

13. Apparatus as specified in claim 12 wherein there are provided first nozzles between said dividing means and said passages and second nozzles between said passages and said intake manifold in the region of said intake ports.

14. Apparatus as specified in claim 1 wherein there is provided heating means at the outlet of said pump for heating said fuel carrying air stream.

15. Apparatus as specified in claim 14 wherein said heating means comprises an electric resistance heating element.

16. Apparatus as specified in claim 1 wherein there is provided a fuel tank connected to said fuel proportioning means and wherein a portion of said fuel carrying air stream is provided from the outlet of said pump to said fuel tank thereby to pressurize said fuel tank.

17. Apparatus as specified in claim 16 wherein there is provided a pressure reducer between said pump and said tank.

18. Apparatus as specified in claim 1 wherein there is provided means for partially reacting said fuel carrying air stream thereby to heat the intake of said engine.

19. Apparatus as specified in claim 18 wherein there are provided means for dividing said fuel carrying air stream into a number of passages, said number being in excess of the number of said cylinders, at least one of said excess passages providing a portion of said fuel carrying air stream to said intake passage, and wherein there is provided means for igniting said air stream from said excess passage in said intake passage, thereby to partially react said fuel.

20. Apparatus as specified in claim 19 wherein there is provided a controllable valve in said excess passage connected to said intake passage.

21. Apparatus as specified in claim 20 wherein said valve is magnetically activated.

22. Apparatus as specified in claim 2 wherein said intake passage includes a throttle, wherein there is provided a fixed tapered bullet in said passage prior to said throttle, a control ring, axially moveable in said passage against a restoring spring and surrounding said bullet to form a variable cross-section annular passage between said bullet and said ring, and wherein said nozzle pin is connected to said control ring and activated by movement of said ring in response to air flow through said passage.

23. Apparatus as specified in claim 22 wherein said control ring is connected to the walls of said intake passage by annular rolling diaphragm.

24. Apparatus as specified in claim 22 wherein said control ring is connected to said nozzle pin by a rod mounted in a cylindrical guide and axially movable in said guide.

25. Apparatus as specified in claim 24 wherein said rod is provided with a screw for adjusting the position of said nozzle pin with respect to said control ring.

26. Apparatus as specified in claim 24 wherein said guide is centrally mounted and coaxial within said intake line, wherein an extension of said guide forms at least a portion of said fuel reservoir, and wherein said second orifice is mounted between said guide and said reservoir.

27. Apparatus as specified in claim 24 wherein there are provided control means for axially moving said control ring according to the operating condition of said engine.

28. Apparatus as specified in claim 27 wherein said control means comprises a spring connecting said ring to said throttle for moving said ring when said throttle is in a fully opened position.

29. Apparatus as specified in claim 27 wherein said control means comprises a damper connected between said throttle and said ring for moving said ring when said throttle is opened rapidly.

30. Apparatus as specified in claim 1 wherein there is provided means for adding exhaust gasses to said air stream.

* * * * *